US005133559A

United States Patent [19]

Page

[11] Patent Number: 5,133,559

[45] Date of Patent: Jul. 28, 1992

[54] CASINO DICE GAME

[76] Inventor: Robert A. Page, 30473 Mulholland Hwg, #139, Agoura, Calif. 91301

[21] Appl. No.: 656,832

[22] Filed: Feb. 19, 1991

Related U.S. Application Data

[63] Continuation-in-part of Ser. No. 565,106, Aug. 9, 1990, Pat. No. D. 321,762.

[51] Int. Cl.[5] ..... A63F 9/04

[52] U.S. Cl. ..... 273/274; 273/146

[58] Field of Search ..... 273/247, 268, 274, 146

[56] References Cited

U.S. PATENT DOCUMENTS

| | | | |
|---|---|---|---|
| 2,922,652 | 1/1960 | Stange | 273/146 |
| 3,043,594 | 7/1962 | Seitz | 273/247 |
| 3,904,208 | 9/1975 | Grossman | 273/274 |
| 4,247,114 | 1/1981 | Carroll | 273/274 |
| 4,312,508 | 1/1982 | Wood | 273/274 |

FOREIGN PATENT DOCUMENTS

| | | | |
|---|---|---|---|
| 757509 | 9/1956 | United Kingdom | 273/146 |
| 2068239 | 8/1981 | United Kingdom | 273/146 |

OTHER PUBLICATIONS

Funkenbusch, W. W. "Sheep Fleecing Dice", *Journal of Recreational Mathematics*, vol. 15(3), 1982-1983, pp. 194-198.

Funkenbusch, W. W. and Saari "Preferences Among Preferences of Nested Cyclic Stochastic Inequalities", *Congressus Numerantium*, vol. 39 (1983), pp. 419-432.

"Mathematical Games: The Paradox of the Nontransitive Dice", *Scientific American*, Dec., 1970, pp. 110-111.

"Encyclopedia of Games" by John Scarne, (New York: Harper & Row Publishers) 1973, pp. 473-474.

*Primary Examiner*—William H. Grieb

*Assistant Examiner*—William M. Pierce

*Attorney, Agent, or Firm*—James Bartholomew; Andrew Jordan

[57] ABSTRACT

The invention comprises a set of six dice that provides two groups of intransitive dice, each group containing three dice (10, 20 and 30). The dice of one group are sized larger than those of the other group. Each die is one of three colors and each group of three intransitive dice includes a die of each color. The six dice are used in a casino game wherein all dice are rolled and then twelve possible bets are resolved. These bets fall into three catagories: contests between two dice of the same size but different colors, contests between two dice of one color and two dice of another color, and contests matching two dice, each of a different color and different size versus another two dice, each of a different color and different size. Game apparatus includes a layout (40) providing twelve betting areas (A-L) and chips (50) for placing wagers on twelve possible bets.

20 Claims, 1 Drawing Sheet

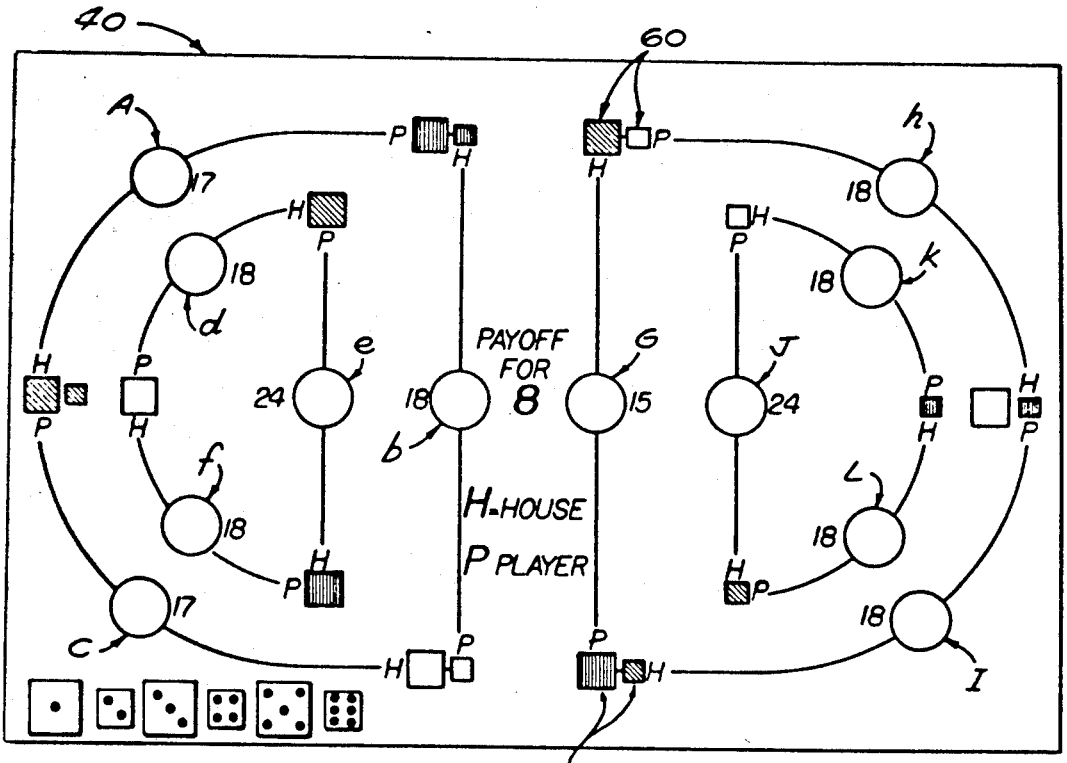
FIG. 1
FIG. 2
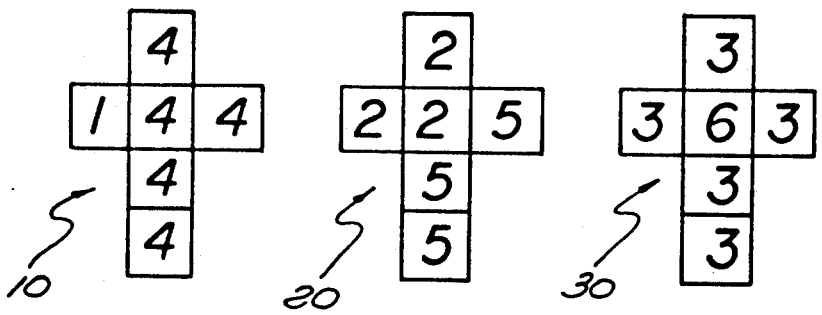
FIG. 3
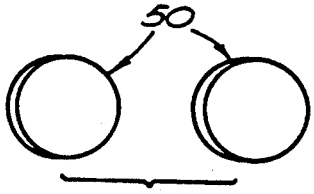

CASINO DICE GAME

TECHNICAL FIELD

This is a continuation-in-part of design application Ser. No. 07/565,106, filed Aug. 9, 1990 and now U.S. Pat. No. 321,762.

The present invention relates generally to the field of games of chance and amusement. More particularly, this invention relates to dice games and wagering or betting layouts and tables, such as casino dice game apparatus.

BACKGROUND ART

A popular game in casinos is craps which is a game of chance played with two dice. While craps is an extremely exciting game, the rules thereof are relatively complex. As a result, the game tends to appeal more to experienced gamblers and attracts a comparatively smaller amount of wagering from novice players, as amateurs often shy away from risking monetary losses in a complex contest demanding quick decisions. There has, therefore, been a need for a casino dice game of chance which has the excitement and fast pace of craps but which is simpler to play and understand so that inexperienced gamblers will be drawn to play.

Furthermore, in order to enhance its appeal to gamblers of all types, such a needed dice game should provide outcomes that can be readily grouped into betting categories that allow for a player to compete against "the house" (i.e. that casino which is bankrolling the game) while ensuring that no ties between a player and the house are possible. The elimination of tie results is highly desirable because this maintains a fast paced, exciting atmosphere which is generally associated with games of non-stop action that decide a winner and loser on every play. As yet an added appeal to gamblers, it would be desirable if a dice game were to be created such that the available bets on the game's outcome were grouped in small sets, wherein a gambler could be guaranteed to win at least one bet, and possibly more, when making each bet of a set. Preferably, three related bets would constitute a set so that a gambler would readily be able to cover all bets in a set, if desired.

In order to appeal to casinos, a dice game is needed which has an acceptable (to casinos) built-in house edge and which encourages the use of betting "systems" by experienced professional gamblers while also thwarting the successful development of such systems. Finally, for psychological reasons, a new dice game should preferably not use any numbers other than one through six on the dice. This is because a conventional die does not display a numeric value above six and this is a value limit that experienced gamblers are used to and feel comfortable with. Again, this criteria relates back to the overall objective to provide a new dice game which is easy to understand, simple to play and which avoids mysterious rules or elements. The present invention fulfills the above-noted needs and provides further related advantages.

DISCLOSURE OF THE INVENTION

The present invention resides in a casino game that utilizes two groups of cubical intransitive dice, each group containing three dice for a total of six dice overall. Dice in one group are sized larger than dice in the other group. The six dice are each one of three colors, with each group containing one die of each color. These dice are unorthodox in that the numeric values 1, 2, 3, 4, 5 and 6 are not represented on each of the six faces of each die. Rather, each die repeats one or more numeric values thereon and each die omits one or more numeric values. Preferably, two of the six dice present the numeric values 1, 4, 4, 4, 4, 4, two dice present the values 2, 2, 2, 5, 5, 5, and two dice present the values 3, 3, 3, 3, 3, 6. This unconventional choice of numeric values on each die gives rise to the intransitivity of the dice. Advantageously, two or more dice in competition with each other will not tie because competing dice will always have different numeric values thereon.

The game includes a playing board or layout which designates and provides wagering areas on twelve different bets. These twelve bets can be catagorized into three types: bets on contests between 2 dice of the same size but different colors, bets on contests between 2 dice of one color and 2 dice of another color, and bets on contests matching 2 dice, each of a different color and different size versus another 2 dice, each also of a different size and different color.

Advantageously, the above contests decided by the intransitive dice are selected to provide for a built-in house edge in this game, currently named "Casino Merry Go Round". Moreover, the unconventional assignment of numeric values to the six dice, as well as their intransitivity and the fact that these dice are rolled by, and remain in the hands of the house at all times, provide factors which help thwart the success of a betting "system" by experienced gamblers. This adds to the appeal of Casino Merry Go Round to casinos.

The playing of this game comprises the steps of establishing a house and players, allowing players to place bets, rolling of the six dice by the house, and rewarding the players according to attained bets. The previously noted dice contests are won by the die displaying the higher numeric value. In contests pitting one combination of two dice versus another combination of two dice, the sum of the numeric values of each pair of dice are used to determine the winning pair, i.e. the pair having a higher sum total.

Other features and advantages of the present invention will become apparent from the following more detailed description, taken in conjunction with the accompanying drawings, which illustrate, by way of example, the principles of the invention.

BRIEF DESCRIPTION OF THE FIGURES

The accompanying drawings illustrate the invention. In such drawings:

FIG. 1 is a top plan view of a layout for accommodating bets on the casino game of the present invention, illustrating circles that designate betting areas and squares of various sizes and colors that indicate which contests may be wagered upon using the betting areas;

FIG. 2 is a schematic view depicting a preferred set of dice for use in this casino game, with the dice shown in an unfolded schematic so that all six faces of each cubical die can be seen at once; and FIG. 3 is a perspective view of betting tokens suitable for placement upon the betting areas of FIG. 1, in order to indicate a player's bet selection and amount to be wagered.

BEST MODE FOR CARRYING OUT THE INVENTION

As shown in the drawings for purposes of illustration, the present invention resides in a dice game especially designed for casino use, but also suitable for enjoyment as a family parlor game.

The present invention, named "Casino Merry Go Round", is a new casino dice game that advantageously utilizes one or more sets of intransitive dice in order to ensure that a player may bet on any die or any of the available dice combinations and still leave a die or dice combination available for the "house" (i.e. casino) which is more likely to win than the player's selection. This ensures that a house edge is built right into the game, thereby adding to the invention's appeal to casinos. Moreover, in order to appeal to the players, the intransitivity of the dice allows for the grouping of potential bets into small sets of three bets, each set being such that a gambler is guaranteed to win at least one, and possibly two, of the three bets in a set, if said gambler wagers on each bet in the set.

The present invention invites the use of "systems" by professional or experienced gamblers but foils their success because the dice are unconventionally numbered and are kept out of the hands of the players by being rolled in a rotatable dice cage run by the house. This thwarting of gambling systems is desirable to casinos and, in this case, would arise in part because the exact numbering arrangement of six unconventionally numbered dice (the preferred number of dice for use in Casino Merry Go Round) will be difficult to ascertain since access to the dice will be denied the public.

Advantageously, Casino Merry Go Round eliminates the possibility of tie outcomes because this casino game pits differently numbered dice against each other. Since competing dice will not include any of the same numeric values thereon, no ties can result. The elimination of tie outcomes desirably gives rise to a fast paced, action packed casino game in which winners and losers are decided on each play so that money is continually changing hands.

Yet another beneficial aspect of Casino Merry Go Round is that it meets a difficult to achieve criteria of simultaneously utilizing a set of intransitive dice while also using only dice that contain numeric values between 1 and 6. This achievement would normally be overlooked because most do not realize that many sets of intransitive dice include at least one die having a zero or a numeric value higher than six thereon. The present invention was specially designed to use dice having numeric values chosen from the set 1, 2, 3, 4, 5, and 6. The reason for this is purely psychological—most gamblers feel familiar and comfortable with dice having numeric values between 1 and 6 (inclusive) thereon and it is desirable to avoid the use, for example, of a "0" or "7" on a die because this practice is unconventional and may alienate hard core dice players.

Before proceeding further, it may be instructive to define "intransitive" dice. Three dice, for example die A, die B and die C, comprise a set of intransitive dice if, in a game between any two dice where the die displaying the higher numeric value wins, die A beats die B more than 50% of the time, die B beats die C more than 50% of the time, and die C beats die A more than 50% of the time. This is in contrast to conventional logic which would normally figure that, if die A beats die B, and die B beats die C, then die A should beat die C also.

The intransitivity of the dice in Casino Merry Go Round arises from the unconventional assignment of numeric values to each die. The game utilizes six dice, each being one of two sizes, big (B) or small (S) and one of three colors. Each color is used twice in the set of six dice; once on a big die and once on a small die. For the sake of example, the colors white (W), red (R), and green (G) were selected to illustrate the principles of this game. Table 1 presents the most preferred assignment of numeric values to the six dice which will achieve the afore-mentioned intransitivity. The assignment of numeric values related in Table 1 is also presented in FIG. 2 as a schematic view of 3 dice numbered in a Table 1 manner, but unfolded so that all six faces of each die become visible.

TABLE 1

Preferred Values of Dice

Legend: BR = Big Red die; SR = Small Red die; BG = Big Green die; SG = Small Green die; BW = Big White die; SW = Small White die

| DIE | NUMERIC VALUES ON DIE FACES |
|---|---|
| BR | 1, 4, 4, 4, 4, 4 |
| BW | 2, 2, 2, 5, 5, 5 |
| BG | 3, 3, 3, 3, 3, 6 |
| SR | 2, 2, 2, 5, 5, 5 |
| SW | 3, 3, 3, 3, 3, 6 |
| SG | 1, 4, 4, 4, 4, 4 |

The dice to be used in Casino Merry Go Round are a conventional cube shape. This cubic configuration provides six flat surfaces or faces, each of equal area, suitable for displaying indicia thereon. In FIG. 2, indicia in the form of integers is used to assign a numeric value to each surface of each die. However, the indicia used to indicate a numeric value need not be configured as a numeral, but rather, said numeric value can be indicated by provision of a number of dots on each surface, as is a commonly accepted practice. In this game, use of dots to assign numeric values to die surfaces is preferred, although other indicia capable of representing a numeric value is also suitable for use. Each of the dice used in Casino Merry Go Round is a "fair" die, that is, each of the six surfaces of each die has an equal probability of facing upwardly after said dice come to a rest following a roll of the dice. The numeric value to be obtained from each die is read from whichever die surfaces are upwardly directed following a roll of the die.

The three colors of the dice can be chosen to emphasize any number of themes, for example, the colors red, white and blue could convey a patriotic theme, while the colors red, white and green could support a Mexican or Italian theme since those are the flag colors for those two nationalities.

In summary, the dice set for the preferred embodiment of the invention will include a big red die, a small red die, a big green die, a small green die, a big white die and a small white die. For the die numbering presented in Table 1, the group of six dice will include two sets of intransitive dice, the first set consisting of the three small dice and the second set consisting of the three big dice. The numeric values assigned to the dice in Table 1 are preferred because each assigned value lies between 1 and 6 inclusive. However, in doing a computer analysis of over 5.7 million potential dice numbering arrangements, taking desired odds into account to ensure a built-in house edge, a total of 15 intransitive dice sets (see Table 2) were discovered as being suitable for use in Casino Merry Go Round. Only one of the 15 is preferred because the other fourteen dice sets each include at least one numeric value that is a "7", "8", "9" or "10". Use of those numbers on dice is highly unorthodox in the gambling world so that the use of these fourteen dice sets is discouraged because such a practice may disorient or alienate an experienced dice player. However, Casino Merry Go Round may also be configured as a portable family parlor game, in which case the reservations associated with making this game palatable for high rolling gamblers are no longer applicable, and thus any of the dice sets of Table 2 would be acceptable.

TABLE 2

| | Intransitive Dice Sets (uses TABLE 1 legend) | | |
|---|---|---|---|
| Set | Numeric values on BR and SG dice | Numeric values on BG and SW dice | Numeric values on BW and SR dice |
| 1 | 1, 4, 4, 4, 4, 4 | 3, 3, 3, 3, 3, 6 | 2, 2, 2, 5, 5, 5 |
| 2 | 1, 1, 4, 4, 4, 7 | 3, 3, 3, 3, 3, 6 | 2, 2, 2, 5, 5, 5 |
| 3 | 1, 4, 6, 6, 6, 6 | 3, 5, 5, 5, 5, 8 | 2, 2, 2, 7, 7, 7 |
| 4 | 1, 4, 6, 8, 8, 8 | 3, 3, 5, 5, 7, 10 | 2, 2, 2, 9, 9, 9 |
| 5 | 1, 4, 6, 6, 6, 6 | 3, 3, 5, 5, 5, 8 | 2, 2, 3, 7, 7, 7 |
| 6 | 1, 4, 4, 6, 6, 6 | 3, 3, 3, 5, 5, 8 | 2, 2, 2, 7, 7, 7 |
| 7 | 1, 4, 6, 6, 8, 8 | 3, 3, 3, 5, 7, 10 | 2, 2, 2, 9, 9, 9 |
| 8 | 1, 4, 6, 8, 8, 8 | 3, 3, 3, 5, 7, 10 | 2, 2, 2, 9, 9, 9 |
| 9 | 1, 4, 6, 6, 6, 6 | 3, 3, 3, 5, 5, 8 | 2, 2, 2, 7, 7, 7 |
| 10 | 1, 4, 4, 4, 4, 6 | 3, 3, 3, 3, 5, 8 | 2, 2, 2, 7, 7, 7 |
| 11 | 1, 4, 4, 4, 6, 6 | 3, 3, 3, 3, 5, 8 | 2, 2, 2, 7, 7, 7 |
| 12 | 1, 4, 4, 6, 6, 6 | 3, 3, 3, 3, 5, 8 | 2, 2, 2, 7, 7, 7 |
| 13 | 1, 4, 6, 6, 6, 6 | 3, 3, 3, 3, 5, 8 | 2, 2, 2, 7, 7, 7 |
| 14 | 1, 4, 4, 4, 7, 7 | 3, 3, 3, 6, 6, 6 | 2, 5, 5, 5, 5, 5 |
| 15 | 1, 1, 4, 7, 7, 7 | 3, 3, 3, 6, 6, 6 | 2, 2, 2, 5, 8, 8 |

The most preferred intransitive dice set of Table 1 is also depicted schematically in FIG. 2, showing the six surfaces of three die cubes in an "unfolded" configuration so that all faces are visible in a single view. It is only necessary to show three dice in FIG. 2 because each die's numerical value assignment is repeated on another die of a different color and different size in order to arrive at the final group of six playing dice total. Thus, in FIG. 2, schematic die 10 presents the numerical values to be assigned to both the big red die (BR) and the small green die (SG); schematic die 20 presents the values to be assigned to both the big white die (BW) and the small red die (SR); and schematic die 30 presents the values for both the big green die (BG) and the small white die (SW).

A game board or layout 40 (see FIG. 1) comprising a substrate, such as a flexible thin sheet of plastic, foam, velvet or felt, is provided to accommodate players' bets on the action of the six playing dice and also to explain and define the various dice contests that take place with each roll of all six dice. Preferably, the layout 40 should provide a smooth, relatively slick playing surface in order to allow betting chips to be easily moved about on the layout. The layout may be of alternative suitable construction, depending upon considerations of cost and frequency of use. For a home parlor version of Casino Merry Go Round, a small foldable cardboard layout is recommended. The layout 40 depicted in FIG. 1 is also the subject of a pending U.S. design patent application, Ser. No. 07/565,106, filed Aug. 9, 1990 and incorporated herein by reference.

For a casino game, preferably the layout 40 will be placed or mounted over the horizontal top of a gambling table having several sides adapted for players and at least one side adapted to be reserved for one or more house representatives or overseers. To accommodate casino betting volume, each players' side of the table should provide room for at least three or four players. The actual form of such a table (whether rectangular, trapezoidal, etc.) is of no importance, the table mainly serving to support the layout at a height which is suitable for the players.

The layout 40 provides a playing surface marked with indicia to define circular betting areas, said betting areas being labeled with reference letters A–L in FIG. 1. The layout 40 also includes indicia such as "H=House", "P=Player" and "Payoff for 8". The indicia consisting of numerals 15, 17, 18, and 24, each adjacent to a betting area A–L, provides labels indicating the payoff for 8 chips bet on a particular betting area A–L. Other playing instructions, etc. may also be included on the layout 40. The game apparatus includes a plurality of betting tokens or chips 50 (FIG. 3), or the like, which are adapted to be placed in the various betting areas by gamblers. Betting chips of various colors are conventional, with the various colors representing different monetary values or denominations. Completing the game apparatus is a conventional rotatable dice cage (not shown), for it is intended that the six dice in Casino Merry Go Round be rolled by a house representative rather than by members of the betting public. Such a dice cage should retain the six dice at all times during playing of the game. The cage is manually rotated to shake and roll the dice therein, thus producing a new set of dice outcomes suitable for resolving bets. The die indicia (and hence the numeric value) to be read on each die is that indicia which is directed upwardly when the dice come to rest after the cage has been rotated. That is, as conventional, the upwardly directed surface of each die is to be read to obtain that die's numeric value.

The meaning of the indicia on the layout 40 helps novices to understand which dice contests are being run by the house each time it rolls the six dice. The large and small squares 60 represent the large and small sizes of the six dice. Each square 60 is colored one of three colors (in this example, either red, white or green) to represent the die of the corresponding color and size. The different colors of squares 60 in FIG. 1 is indicated by various shading schemes. Note that each betting area A–L is a circle that lies along a line. Each line has a "P" at one end and a "H" at the opposite end. As noted by indicia on the layout 40, the "H" stands for house and the "P" stands for player.

The layout 40 may also have open, unmarked areas which can be used by one or more house overseers for storage of chips, markers, rakes, or other game apparatus and for more convenient access to the betting areas to collect losing bets and to pay winning bets.

With the above designations in mind, an example is now in order. Note betting area "A" in FIG. 1. It lies on a line having a big green and a little green square at its end designated "H" and having a big red and a little red square at its end designated "P". As previously noted, the squares represent dice, so in this instance, one placing a bet on betting area "A" would be wagering on the numeric value produced by the sum of the big red die and the little red die (because the squares corresponding to those dice are marked "P" at the end of a line running to circle "A") and this sum would be matched against the numeric value produced by the sum of the big green die and the little green die (because the squares corresponding to those dice are marked "H" at the end of a line running to circle "A"). The numeral "17" adjacent to the betting circle "A" indicates to a player that for every 8 chips bet on circle "A" (that is bet on the two red dice vs. the two green dice), 17 chips will be repaid to the player if the red dice sum is higher than the green dice sum.

Similarly, if one placed a bet in circle "E", that would be a bet on the big green die (because the square corresponding to the big green die is marked "P" at the end of a line running to circle "E") and would be a bet against the big red die (because the square corresponding to the big red die is marked "H" at the end of a line running to circle "E"). The numeral "24" adjacent to the circle "E" indicates that for every 8 chips bet in circle "E", 24 chips will be repaid to the player placing said wager, if the numeric value of the big green die turns out to be higher than the numeric value of the big red die. In all, 12 betting areas are designated A-L in FIG. 1. These represent the 12 types of bets available in Casino Merry Go Round. These 12 bets fall into three basic categories: 1.) bets on contests between a die of a certain size and color vs. another die of the same size but different color; 2.) bets on contests between 2 dice of one color vs. 2 dice of another color (wherein paired dice are summed); and 3.) bets on contests between a pair of two dice, each of a different color and different size vs. another pair of two dice, each of a different color and different size. Table 3 summarizes the 12 available bets, which correspond to the 12 betting areas A-L, by tabulating which die or dice pair that a particular betting area will place a wager on and by also noting which dice contest will place a wager on and by also noting which dice contest will involve the particular die or dice pair being wagered on.

TABLE 3

(uses TABLE 1 Legend)

| Betting Area (designated by reference letter) | Area Places Bet On: | Dice Contest Being Wagered On: |
|---|---|---|
| A | Sum of BR + SR | (Sum of BR + SR) vs. (Sum of BG + SG) |
| B | Sum of BW + SW | (Sum of BW + SW) vs. (Sum of BR + SR) |
| C | Sum of BG + SG | (Sum of SG + BG) vs. (Sum of BW + SW) |
| D | BW | BW vs. BG |
| E | BG | BG vs. BR |
| F | BR | BR vs. BW |
| G | Sum of BR + SG | (Sum of BR + SG) vs. (Sum of BG + SW) |
| H | Sum of BG + SW | (Sum of BG + SW) vs. (Sum of BW + SR) |
| I | Sum of BW + SR | (Sum of BW + SR) vs. (Sum of BR + SG) |
| J | SW | SW vs. SG |
| K | SR | SR vs. SW |
| L | SG | SG vs. SR |

As noted, Casino Merry Go Round offers dice contests in which a pair of dice representing a player compete against a pair of dice representing the house. The favored outcome of such a dice contest between rival dice pairs is unexpected in view of what one would predict based on the favored outcomes associated with each individual die of a dice pair. This characteristic is symptomatic of the intransitive nature of the dice and is best illustrated by example. Note the dice contest waged to resolve bet "h" on layout 40: the pairing of the big green die (BG) with the small white die (SW) will represent the player versus the pairing of the big white die (BW) with the small red die (SR), representing the house. If one were to try and predict the favored outcome of bet "h" based on the performance record of each individual die involved in that contest, it would be noted that the true odds favor SW to beat SR a majority of the time and that BG is favored to beat BW a majority of the time (see Table 5). Based on this, logic would seem to indicate that a pairing of SW+BG (the two favorites in individual die comparisons) would be favored to beat a pairing of SR+BW (the two underdogs in individual die comparisons). However, in actuality, the pairing of SR+BW is favored to beat the pairing of SW+BG a majority of the time (see Table 5). This unexpected result holds true in the analysis of other competing dice pairs and arises because of the unorthodox assignment of numeric values to each die, thereby causing intransitivity. This feature, whereby a pair of dice which individually are underdogs become a cumulative favorite over a pair of dice which individually are favorites, is an unusual twist that adds to the unpredictability and excitement of Casino Merry Go Round.

The twelve available bets, which correspond to the twelve betting areas A-L, are grouped into ten combinations. Each combination includes three bets. These ten combinations are set forth in Table 4. Advantageously, the grouping of the betting areas A-L into combinations of three bets was done such that a gambler betting on all three bets comprising a combination will be guaranteed to win at least one, and possibly two, of the three bets. This guarantee is possible because of the intransitivity of the dice used in Casino Merry Go Round. Table 4 also presents the average house edge on the three bets of each combination. This feature, whereby at least one bet of each three bet combination will be won by a player betting the entire combination, provides an attractive selling point that adds to the appeal of Casino Merry Go Round. Thus, out of the twelve bets decided on each roll of six dice, there will never be less than 4 nor more than 8 winners for the player or the house. This provides a balance whereby the betting public is always winning between 4 and 8 bets (assuming all 12 bets are made by players)—a feature that will help entice players to continue to play. This is in contrast to some casino games wherein a casino can win all bets given certain circumstances, an undesirable scenario that will frustrate players and discourage further play. As an example of a scenario wherein a player making all twelve potential bets will win the guaranteed minimum of four bets, consider a house roll resulting in the following numeric values being displayed on the six dice: BW=5, BR=SG=4, BG=SW=3, and SR=2. In this instance, a player making all twelve bets would win bets "B, D, G and L". To illustrate a scenario wherein a player making all twelve bets will win the maximum of eight bets, consider a house roll resulting in the following numeric values being displayed on the six dice: BG=6, SR=5, BR=4, SW=3, BW=2 and SG=1. In this instance, the player would win bets "A, C, E, F, H, I, J, and K."

TABLE 4

Betting Groups

| Betting Areas in Group | Average House Edge on 3 bets of group |
|---|---|
| A, B, C | 8.60 |
| D, E, F | 6.94 |
| G, H, I | 8.40 |
| J, K, L | 6.94 |
| A, E, L | 7.86 |
| B, F, K | 6.77 |
| C, D, J | 7.86 |
| G, E, J | 8.75 |

TABLE 4-continued

| Betting Groups | |
|---|---|
| Betting Areas in Group | Average House Edge on 3 bets of group |
| H, D, K | 6.77 |
| I, F, L | 6.77 |

The true odds for the twelve dice contests decided in Casino Merry Go Round are presented in Table 5. All tables 4–6 are based on results achievable with the preferred set of dice presented in Table 1. Table 6 presents the payoff ratio and house edge percentage for the twelve bets A–L. The house edge of Table 6 is achieved in part because a difference exists between the true odds (Table 5) and the actual payoff ratios (Table 6). For example, the bet associated with betting area "e" matches a player's big green die (BG) vs. the house's big red die (BR). From Table 5, it should be noted that BR is favored over BG by 2.27 to 1. However, the actual payoff the bet "e" (from Table 6) is only 2 to 1. Thus, a small house edge is achieved, in part, by a payoff at less than true odds. The payoff ratios presented in Table 6 are preferred, however, casinos can change the payoff rate without departing from the spirit and scope of this invention. The payoff ratio was set forth based on an 8 chip bet in order to avoid indicating payoff amounts on the layout 40 that include fractions. For example, bet "h", if won, will pay off 18 chips for every 8 chips bet. This payoff could also be expressed as 2.25 to 1. In this instance, the 18 chip payoff would consist of 10 chips that were won and a refund of the original 8 chips that were bet by the player. Only the single payoff of 15 chips, associated with bet "g" is a payoff at less than a 1 to 1 ratio.

TABLE 5

| (use Table 1 Legend) | |
|---|---|
| Favored result using preferred numbering of dice | True Odds |
| BR > BG | 2.27 > 1 |
| BG > BW | 1.4 > 1 |
| BW > BR | 1.4 > 1 |
| SG > SW | 2.27 > 1 |
| SW > SR | 1.4 > 1 |
| SR > SG | 1.4 > 1 |
| BR + SR > BW + SW | 1.44 > 1 |
| BW + SW > BG + SG | 1.34 > 1 |
| BG + SG > BR + SR | 1.34 > 1 |
| BG + SW > BR + SG | 1.07 > 1 |
| BR + SG > BW + SR | 1.44 > 1 |
| BW + SR > BG + SW | 1.44 > 1 |

TABLE 6

| House Edge Using Preferred Dice Arrangement of FIG. 1 | | |
|---|---|---|
| Betting Area | Payoff Ratio (amt. won to amt. bet) | House Edge Percentage |
| A | 9 to 8 | 9.00 |
| B | 5 to 4 | 7.81 |
| C | 9 to 8 | 9.00 |
| D | 5 to 4 | 6.25 |
| E | 2 to 1 | 8.33 |
| F | 5 to 4 | 6.25 |
| G | 7 to 8 | 9.58 |
| H | 5 to 4 | 7.81 |
| I | 5 to 4 | 7.81 |
| J | 2 to 1 | 8.33 |
| K | 5 to 4 | 6.25 |
| L | 5 to 4 | 6.25 |

While various rules for playing games utilizing the concept and apparatus of Casino Merry Go Round may be developed, it is intended that the game be played in the manner to be now described. Initially, a house and players are established. When a round starts, the players place bets of any amount (8 chips need not be bet each time) on any desired betting area A–L. Next, the house rolls the six dice, preferably using a rotatable dice cage containing the six dice presented in Table 1, and then each of the 12 dice contests (tabulated in Table 3) is resolved. Finally, players are rewarded by the house based on attained bets. In a sophisticated version of Casino Merry Go Round, the layout 40 could be atop a table containing electronics, a keyboard, and indicator lights for each bet such that the results of each die could be keyed in by the house and then the electronics within the table automatically tabulate winning bets and light up the indicator lights corresponding to each bet won by the players. This advanced version may be desirable to avoid delays which may result if house representatives must tally up all 12 bet results.

From the foregoing, it will be appreciated that Casino Merry Go Round provides a fast paced die game that advantageously avoids tie results and that guarantees one or two winning bets within each three bet combination. The intransitive dice provide a built-in house edge which is desirable to casinos and the unorthodox numeric values represented on each of the six dice serve to thwart the use of "systems" by professional gamblers, another attractive feature to casinos. The fact that the six dice remain in the possession of the house at all times ensures that a "system" gambler will have difficulty pinpointing which numeric values are represented on which dice, thereby further hindering the development of a "system" by an experienced gambler. Thus, the present invention advantageously provides a gambling game that has both characteristics which appeal to a player, and characteristics which appeal to a casino.

It is to be understood that the embodiment discussed herein is merely illustrative of the application of the principles of the invention. Numerous modifications may be made therein and other arrangements may be devised without departing from the spirit and scope of the invention. For example, the color of the squares 60 on the layout 40 and the colors of the six dice may be changed, provided that the color correspondence of each square 60 to its associated die is maintained. Moreover, Casino Merry Go Round may be utilized as a carnival game or home parlor game, rather than as a casino game. Accordingly, it is not intended that the invention be limited, except as by the appended claims.

I claim:

1. A casino game comprising:

at least six dice comprising a first die having a first size and a first color;

a second die having a second size which is different from said first size, said second die also being of said first color;

a third die, said third die having said first size and being of a second color different from said first color;

a fourth die, said fourth die having said second size and being of said second color;

a fifth die, said fifth die having said first size and being of a third color different from said first and second colors;

a sixth die, said sixth die having said second size and being of said third color, wherein each of said dice have a cubical configuration providing six surfaces with indicia thereon identifying the surfaces with a numeric value, and wherein each of the six surfaces of each die has an equal probability of facing upwardly after said dice come to a rest following a roll of the dice;

a game layout comprising a substrate, said substrate including indicia that designates a plurality of betting areas for wagering upon different contingencies of rolls of said dice, wherein said indicia on said substrate designates at least one betting area for wagering upon which of two dice having the same size but different colors will display a higher numeric value, following a roll of the dice, and also designates at least one betting area for wagering upon whether the sum total of numeric values displayed by a combination of two dice of one color will be higher than the sum total of numeric values displayed by another combination of two dice of another color, following a roll of the dice, wherein the numeric values resultant from a roll of the dice are established by the dice surfaces which are directed upwardly when the dice come to rest following a roll of the dice.

2. A casino game as set forth in claim 1, wherein said indicia on said substrate also designates at least one betting area for wagering upon whether the sum total of the numeric values displayed by a combination of two dice, each of a different color and different size, will be higher than the sum total of the numeric values displayed by another combination of two dice, each of a different color and different size, following a roll of the dice.

3. A casino game as set forth in claim 1, further including a rotatable dice cage, wherein the dice are kept in said dice cage during playing of the game, wherein rolling the dice includes rotating the dice cage.

4. A casino game as set forth in claim 1, in combination with betting tokens adapted to be placed in said betting areas.

5. A casino game as set forth in claim 1, wherein said at least six dice comprise at least two groups, each group including a set of three intransitive dice.

6. A casino game as set forth in claim 1, wherein die indicia of the first die represents the numeric value "1" on two of the six surfaces of the first die, represents the numeric value "4" on three of the six surfaces of the first die, and represents the numeric value "7" on one of the six surfaces of the first die, wherein indicia on the six surfaces of the fourth die presents the same numeric values as those represented on the first die;

wherein die indicia of the second die represents the numeric value "2" on three of the six surfaces of the second die, and represents the numeric value "5" on three of the six surfaces of the second die, wherein indicia on the six surfaces of the fifth die presents the same numeric values as those represented on the second die; and wherein die indicia of the third die represents the numeric value "3" on five of the six surfaces of the third die, and represents the numeric value "6" on one of the six surfaces of the third die, wherein indicia on the six surfaces of the sixth die presents the same numeric values as those represented on the third die.

7. A casino game as set forth in claim 1, wherein die indicia of the first die represents the numeric value "1" on one of the six surfaces of the first die, represents the numeric value "4" on one of the six surfaces of the first die, and represents the numeric value "6" on four of the six surfaces of the first die, wherein indicia on the six surfaces of the fourth die presents the same numeric values as those represented on the first die;

wherein die indicia of the second die represents the numeric value "2" on three of the six surfaces of the second die, and represents the numeric value "7" on three of the six surfaces of the second die, wherein indicia on the six surfaces of the fifth die presents the same numeric values as those represented on the second die; and wherein die indicia of the third die represents the numeric value "3" on one of the six surfaces of the third die, represents the numeric value "8" on one of the six surfaces of third die, and represents the numeric value "5" on four of the six surfaces of the third die, wherein indicia on the six surfaces of the sixth die presents the same numeric values as those represented on the third die.

8. A casino game as set forth in claim 1, wherein die indicia of the first die represents the numeric value "1" on one of the six surfaces of the first die, represents the numeric value "4" on one of the six surfaces of the first die, represents the numeric value "6" on one of the six surfaces of the first die, and represents the numeric value "8" on three of the six surfaces of the first die, wherein indicia on the six surfaces of the fourth die presents the same numeric values as those represented on the first die;

wherein die indicia of the second die represents the numeric value "2" on three of the six surfaces of the second die, and represents the numeric value "9" on three of the six surfaces of the second die, wherein indicia on the six surfaces of the fifth die presents the same numeric values as those represented on the second die; and wherein die indicia of the third die represents the numeric value "3" on two of the six surfaces of the third die, represents the numeric value "5" on two of the six surfaces of the third die, represents the numeric value "7" on one of the six surfaces of the third die, and represents the numeric value "10" on one of the six surfaces of the third die, wherein indicia on the six surfaces of the sixth die presents the same numeric values as those represented on the third die.

9. A casino game as set forth in claim 1, wherein die indicia of the first die represents the numeric value "1" on one of the six surfaces of the first die, represents the numeric value "4" on one of the six surfaces of the first die, and represents the numeric value "6" on four of the six surfaces of the first die, wherein indicia on the six surfaces of the fourth die presents the same numeric values as those represented on the first die;

wherein die indicia of the second die represents the numeric value "2" on two of the six surfaces of the second die, represents the numeric value "3" on one of the six surfaces of the second die, and represents the numeric value "7" on three of the six surfaces of the second die, wherein indicia on the six surfaces of the fifth die presents the same numeric values as those represented on the second die; and wherein die indicia of the third die represents the numeric value "3" on two of the six surfaces of the third die, represents the numeric value "5" on three of the six surfaces of the third die, and represents the numeric value "8" on one of the six surfaces of the third die, wherein indicia on the six surfaces of the sixth die presents the same numeric values as those represented on the third die.

10. A casino game as set forth in claim 1, wherein die indicia of the first die represents the numeric value "1" on one of the six surfaces of the first die, represents the numeric value "4" on two of the six surfaces of the first die, and represents the numeric value "6" on three of the six surfaces of the first die, wherein indicia on the six surfaces of the fourth die presents the same numeric values as those represented on the first die;

wherein die indicia of the second die represents the numeric value "2" on three of the six surfaces of the second die, and represents the numeric value "7" on three of the six surfaces of the second die, wherein indicia on the six surfaces of the fifth die presents the same numeric values as those represented on the second die; and wherein die indicia of the third die represents the numeric value "3" on three of the six surfaces of the third die, represents the numeric value "5" on two of the six surfaces of the third die, and represents the numeric value "8" on one of the six surfaces of the third die, wherein indicia on the six surfaces of the sixth die presents the same numeric values as those represented on the third die.

11. A casino game as set forth in claim 1, wherein die indicia of the first die represents the numeric value "1" on one of the six surfaces of the first die, represents the numeric value "4" on one of the six surfaces of the six surfaces of the first die, and represents the numeric value "8" on two of the six surfaces of the first die, wherein indicia on the six surfaces of the fourth die presents the same numeric values as those represented on the first die;

wherein die indicia of the second die represents the numeric value "2" on three of the six surfaces of the second die, and represents the numeric value "9" on three of the six surfaces of the second die, wherein indicia on the six surfaces of the fifth die presents the same numeric values as those represented on the second die; and wherein die indicia of the third die represents the numeric value "3" on three of the six surfaces of the third die, represents the numeric value "5" on one of the six surfaces of the third die, represents the numeric value "7" on one of the six surfaces of the third die, and represents the numeric value "10" on one of the six surfaces of the third die, wherein indicia on the six surfaces of the sixth die presents the same numeric values as those represented on the third die.

12. A casino game as set forth in claim 1, wherein die indicia of the first die represents the numeric value "1" on one of the six surfaces of the first die, represents the numeric value "4" on one of the six surfaces of the first die, represents the numeric value "6" on one of the six surfaces of the first die, and represents the numeric value "8" on three of the six surfaces of the first die, wherein indicia on the six surfaces of the fourth die presents the same numeric values as those represented on the first die;

wherein die indicia of the second die represents the numeric value "2" on three of the six surfaces of the second die, and represents the numeric value "9" on three of the six surfaces of the second die, wherein indicia on the six surfaces of the fifth die presents the same numeric values as those represented on the second die; and wherein die indicia of the third die represents the numeric value "3" on three of the six surfaces of the third die, represents the numeric value "5" on one of the six surfaces of the third die, represents the numeric value "7" on one of the six surfaces of the third die, and represents the numeric value "10" on one of the six surfaces of the third die, wherein indicia on the six surfaces of the sixth die presents the same numeric values as those represented on the third die.

13. A casino game as set forth in claim 1, wherein die indicia of the first die represents the numeric value "1" on one of the six surfaces of the first die, represents the numeric value "4" on one of the six surfaces of the first die, and represents the numeric value "6" on four of the six surfaces of the first die, wherein indicia on the six surfaces of the fourth die presents the same numeric values as those represented on the first die;

wherein die indicia of the second die represents the numeric value "2" on three of the six surfaces of the second die, and represents the numeric value "7" on three of the six surfaces of the second die, wherein indicia on the six surfaces of the fifth die presents the same numeric values as those represented on the second die; and wherein die indicia of the third die represents the numeric value "3" on three of the six surfaces of the third die, represents the numeric value "5" on two of the six surfaces of the third die, and represents the numeric value "8" on one of the six surfaces of the third die, wherein indicia on the six surfaces of the sixth die presents the same numeric values as those represented on the third die.

14. A casino game as set forth in claim 1, wherein die indicia of the first die represents the numeric value "1" on one of the six surfaces of the first die, represents the numeric value "4" on four of the six surfaces of the first die, and represents the numeric value "6" on one of the six surfaces of the first die, wherein indicia on the six surfaces of the fourth die presents the same numeric values as those represented on the first die;

wherein die indicia of the second die represents the numeric value "2" on three of the six surfaces of the second die, and represents the numeric value "7" on three of the six surfaces of the second die, wherein indicia on the six surfaces of the fifth die presents the same numeric values as those represented on the second die; and wherein die indicia of the third die represents the numeric value "3" on four of the six surfaces of the third die, represents the numeric value "5" on one of the six surfaces of the third die, and represents the numeric value "8" on one of the six surfaces of the third die, wherein indicia on the six surfaces of the sixth die presents the same numeric values as those represented on the third die.

15. A casino game as set forth in claim 1, wherein die indicia of the first die represents the numeric value "1" on one of the six surfaces of the first die, represents the numeric value "4" on three of the six surfaces of the first die, and represents the numeric value "6" on two of the six surfaces of the first die, wherein indicia on the six surfaces of the fourth die presents the same numeric values as those represented on the first die;

wherein die indicia of the second die represents the numeric value "2" on three of the six surfaces of the second die, and represents the numeric value "7" on three of the six surfaces of the second die, wherein indicia on the six surfaces of the fifth die presents the same numeric values as those represented on the second die; and wherein die indicia of the third die represents the numeric value "3" on four of the six surfaces of the third die, represents the numeric value "5" on one of the six surfaces of the third die, and represents the numeric value "8" on one of the six surfaces of the third die, wherein indicia on the six surfaces of the sixth die presents the same numeric values as those represented on the third die.

16. A casino game as set forth in claim 1, wherein die indicia of the first die represents the numeric value "1" on one of the six surfaces of the first die, represents the numeric value "4" on two of the six surfaces of the first die, and represents the numeric value "6" on three of the six surfaces of the first die, wherein indicia on the six surfaces of the fourth die presents the same numeric values as those represented on the first die;

wherein die indicia of the second die represents the numeric value "2" on three of the six surfaces of the second die, and represents the numeric value "7" on three of the six surfaces of the second die, wherein indicia on the six surfaces of the fifth die presents the same numeric values as those represented on the second die; and wherein die indicia of the third die represents the numeric value "3" on four of the six surfaces of the third die, represents the numeric value "5" on one of the six surfaces of the third die, and represents the numeric value "8" on one of the six surfaces of the third die, wherein indicia on the six surfaces of the sixth die presents the same numeric values as those represented on the third die.

17. A casino game as set forth in claim 1, wherein die indicia of the first die represents the numeric value "1" on one of the six surfaces of the first die, represents the numeric value "4" on one of the six surfaces of the first die, and represents the numeric value "6" on four of the six surfaces of the first die, wherein indicia on the six surfaces of the fourth die presents the same numeric values as those represented on the first die;

wherein die indicia of the second die represents the numeric value "2" on three of the six surfaces of the second die, and represents the numeric value "7" on three of the six surfaces of the second die, wherein indicia on the six surfaces of the fifth die presents the same numeric values as those represented on the second die; and wherein die indicia of the third die represents the numeric value "3" on four of the six surfaces of the third die, represents the numeric value "5" on one of the six surfaces of the third die, and represents the numeric value "8" on one of the six surfaces of the third die, wherein indicia on the six surfaces of the sixth die presents the same numeric values as those represented on the third die.

18. A casino game as set forth in claim 1, wherein die indicia of the first die represents the numeric value "1" on one of the six surfaces of the first die, and represents the numeric value "4" on five of the six surfaces of the first die, wherein indicia on the six surfaces of the fourth die presents the same numeric values as those represented on the first die;

wherein die indicia of the second die represents the numeric value "2" on three of the six surfaces of the second die, and represents the numeric value "5" on three of the six surfaces of the second die, wherein indicia on the six surfaces of the fifth die presents the same numeric values as those represented on the second die; and wherein die indicia of the third die represents the numeric value "3" on five of the six surfaces of the third die, and represents the numeric value "6" on one of the six surfaces of the third die, wherein indicia on the six surfaces of the sixth die presents the same numeric values as those represented on the third die.

19. A casino game as set forth in claim 1, wherein die indicia of the first die represents the numeric value "1" on one of the six surfaces of the first die, represents the numeric value "4" on three of the six surfaces of the first die, and represents the numeric value "7" on two of the six surfaces of the first die, wherein indicia on the six surfaces of the fourth die presents the same numeric values as those represented on the first die;

wherein die indicia of the second die represents the numeric value "2" on one of the six surfaces of the second die, and represents the numeric value "5" on five of the six surfaces of the second die, wherein indicia on the six surfaces of the fifth die presents the same numeric values as those represented on the second die; and wherein die indicia of the third die represents the numeric value "3" on three of the six surfaces of the third die, and represents the numeric value "6" on three of the six surfaces of the third die, wherein indicia on the six surfaces of the sixth die presents the same numeric values as those represented on the third die.

20. A casino game as set forth in claim 1, wherein die indicia of the first die represents the numeric value "1" on two of the six surfaces of the first die, represents the numeric value "4" on one of the six surfaces of the first die, and represents the numeric value "7" on three of the six surfaces of the first die, wherein indicia on the six surfaces of the fourth die presents the same numeric values as those represented on the first die;

wherein die indicia of the second die represents the numeric value "2" on three of the six surfaces of the second die, represents the numeric value "5" on one of the six surfaces of the second die, and represents the numeric value "8" on two of the six surfaces of the second die, wherein indicia on the six surfaces of the fifth die presents the same numeric values as those represented on the second die, and wherein die indicia of the third die represents the numeric value "3" on three of the six surfaces of the third die, and represents the numeric value "6" on three of the six surfaces of the third die, wherein indicia on the six surfaces of the sixth die presents the same numeric values as those represented on the third die.

* * * * *

UNITED STATES PATENT AND TRADEMARK OFFICE

CERTIFICATE OF CORRECTION

PATENT NO. : 5,133,559

DATED : July 28, 1992

INVENTOR(S) : PAGE, Robert A.

It is certified that error appears in the above-indentified patent and that said Letters Patent is hereby corrected as shown below:

In claim 11, col. 13, line 4, insert --of the first die, represents the numeric value "6" on two-- between "of the six surfaces" and "of the six surfaces of the first die".

Signed and Sealed this

Twelfth Day of October, 1993

*Attest:*

*Attesting Officer*

Bruce Lehman

BRUCE LEHMAN

*Commissioner of Patents and Trademarks*